US006783317B2

(12) United States Patent
Claeys

(10) Patent No.: US 6,783,317 B2
(45) Date of Patent: Aug. 31, 2004

(54) METHOD AND DEVICE FOR STACKING FLAT-FOLDED BOXES

(76) Inventor: Eric Claeys, Zouterweg 8, B-8670 Oostduinkerke (BE)

( * ) Notice: Subject to any disclaimer, the term of this patent is extended or adjusted under 35 U.S.C. 154(b) by 0 days.

(21) Appl. No.: 10/182,533

(22) PCT Filed: Feb. 22, 2001

(86) PCT No.: PCT/BE01/00027

§ 371 (c)(1),
(2), (4) Date: Nov. 14, 2002

(87) PCT Pub. No.: WO01/62643

PCT Pub. Date: Aug. 30, 2001

(65) Prior Publication Data

US 2003/0100422 A1 May 29, 2003

(30) Foreign Application Priority Data

Feb. 22, 2000 (EP) ..... 00200598

(51) Int. Cl.[7] ..... B65B 35/50; B65G 57/00; B65H 29/00; B65H 31/34; B65H 31/30

(52) U.S. Cl. ..... 414/788.1; 414/788.4; 414/788.9; 414/790.3

(58) Field of Search ..... 414/788.1, 788.4, 414/788.9, 790.3, 790.7

(56) References Cited

U.S. PATENT DOCUMENTS 2,708,863 A * 5/1955 Payne ..... 414/788.1
3,638,538 A 2/1972 Sullivan
3,964,598 A * 6/1976 Alsop ..... 198/415
4,058,226 A * 11/1977 Peters, Jr. ..... 414/790.3
4,979,670 A 12/1990 Konle
5,733,099 A * 3/1998 Honneger ..... 414/788

FOREIGN PATENT DOCUMENTS

| | | |
|---|---|---|
| AT | 343 150 | 5/1978 |
| WO | WO 88/00921 A1 | 2/1998 |
| WO | WO 88/00922 A1 | 2/1998 |

* cited by examiner

*Primary Examiner*—Gene O. Crawford
(74) *Attorney, Agent, or Firm*—Barnes & Thornburg

(57) ABSTRACT

A machine for building a stack of stiff flat articles comprises an input device for feed of a horizontal flow of flat articles in an overlapping shingled relationship and travelling in a first direction, a pusher mechanism for engaging with a side of one of the flat articles and for driving a plurality of flat articles into a vertical stack at a first location. The pusher mechanism comprises a carriage device for movement in the first direction, a bottom-pusher mechanism mounted on the carriage and a top-pusher mechanism mounted on the carriage. The machine further comprises a control device for controlling movements of the bottom or top or bottom pusher mechanisms such that, if the horizontal flow of articles is top-stacked, the bottom pusher mechanism engages a side of one of the flat articles and drives a plurality of the flat articles into the vertical stack, and if the horizontal flow of articles is under-stacked, the top-pusher mechanism at least pushes off a plurality of flat articles to for the vertical stack.

24 Claims, 14 Drawing Sheets

METHOD AND DEVICE FOR STACKING FLAT-FOLDED BOXES

TECHNICAL FIELD OF THE INVENTION

The present invention relates to forming a plurality of flat, stiff articles such as flat-folded boxes flowing as a stream of overlapping shingled flat articles, into a stack, more particularly to a method and a device for automatically doing so as well as a device for counting the number of flat articles formed into the stack.

BACKGROUND OF THE INVENTION

In the production of corrugated boxes, corrugated board produced at a corrugated machine is cut and converted into blanks of a desired shape, which are then may be printed or surface finished in some other way. Thereafter, the blanks are flat-folded and glued to form boxes, in a machine commonly known as a folder-gluer machine.

At the outlet of a folder-gluer machine, individual flat-folded and glued boxes are stacked in an overlapping shingled relationship, either in under-stacking or in top-stacking. Under-stacking means that there is a preceding box and a subsequent box, each with a leading edge and a trailing edge (seen in the direction of movement on a moving mechanism such as a conveyor belt), the preceding box being deposited on the moving mechanism before the subsequent box, and whereby the leading edge of the subsequent box is deposited on said moving mechanism under the trailing edge of said preceding box. Top-stacking means that there is a preceding box and a subsequent box, each with a leading edge and a trailing edge again, the preceding box being deposited on the moving mechanism before the subsequent box, whereby the leading edge of the subsequent box is deposited on the moving mechanism on top of the trailing edge of the preceding box.

This shingled flow is moved on between drying pressing belts to be pressed together well and to give sufficient glue drying time, in order to prevent unfolding of the boxes before their glue sets. After leaving the drying pressing belt, generally controlled packets, comprising one or more stacks made in a packeting machine from this flow of shingled individual boxes, are supplied to a strapping machine or strapping section, in order finally to be stacked neatly by a palletising station.

To achieve stable stacking on a pallet, the individual packets should have the same dimension and all opposing sides of the packets must be parallel with each other. Therefore the packeting machine should always make a stack having the same number of individual flat-folded boxes, should align these and where applicable compensate for any angled sides by placing another stack rotated through 180° or another suitable angle (e.g. 90°) on the top, thus forming a packet. This block-like packet is then offered in a way ready positioned for the strapping machine.

In recent years suppliers of machines for handling corrugated cardboard have made significant innovations, especially in the field of folder-gluer machines, which have become considerably faster and more flexible in formats and types of boxes they can handle. The set-up time of such machines has become low and thus also allows profitability in small series. As always, the weakest link in the chain determines the profitability, and this weakest link is at present the packeting machine or packer installation which is still labour-intensive, and restricted in processing of box formats and types. Apparently, development of the subsequent machines (such as e.g. the packeting machine) has lagged behind despite the fact that investment already made for the folder-gluer machines would normally justify further optimisation of the line. These needs have led some machine manufacturers trying to fulfil demand. Unfortunately, known designs do not meet the range of products and format differences, the requirements due to the existing short set-up time, the restricted installation space and, last but not least, the price.

By increasing the production speed of the folder-gluer machines (to more than 15,000 boxes per hour), an extremely dynamic system is required for the packeting machine, to the extent that now the outer limit of present servo-technology is reached. The flexibility in product dimensions and forms further increases the degree of difficulty of forming packets from a continuously supplied stream of flat-folded boxes. The fact that under-stacking is now used more and more, and that the new folder-gluer machines allow this, means that a special approach is required for forming stacks out of the shingled flow, without neglecting the more traditional form of stacking, known as top-stacking.

Different mechanisms already used to separate individual flat-folded boxes to form a stack have been investigated:

1. Individual acceleration of boxes, which are then pushed under each other to form a stack, or which are dropped on top of each other, thus forming a stack.
2. Acceleration at the lower edge of some of the shingled boxes, which together will form a stack, and dropping them on top of each other one at a time in a catchment tray at a lower level.
3. Insertion of a separation finger in a stack where separation must occur and forward movement of a bridge, where the packet is located straight against an upright stop plate. An example of this has been described e.g. in U.S. Pat. No. 5,493,104.
4. Both accelerating the lower edge and the top edge of shingled boxes, and allowing the boxes to fall into a catchment tray below.
5. Obliquely stacked boxes are raised and allowed to fall individually into a catchment tray where they can fall further as a stack after being counted.

All of these solutions present the disadvantage that either the flat-folded boxes must be presented to the packeting machine on a one by one basis, or the continuous shingled flow has to be stopped, which solutions both slow down the handling.

Furthermore, corrugated cardboard boxes are not always rectangular in structure in a flat-folded state (e.g. locking bottom) and/or are not always glued symmetrically (e.g. an automatic-bottom box has, in flat-folded form, five thicknesses of cardboard where the bottom of the box lies, while it has only two thicknesses of cardboard where the top of the box lies). As a result, a number of boxes pushed onto each other in the same direction, forms a stack with the top side misaligned. Hence, when the boxes are stacked for handling or storage, the stack that is formed will have a tendency to topple if all packs of boxes are stacked in the same direction. To make such a stack into a block, it is known to rotate a second stack through 180° in the vertical or horizontal plane. This is called compensation. Depending on the product form, the packet thus formed is more or less unstable (due to accordion movement).

To compensate for the stacks and eliminate misalignment due to oblique sides, various mechanisms are known.

1. A stack of boxes is manually rotated over 180° and placed on top of a stack of boxes previously formed.
2. The boxes fall on a catchment plate and form a stack. This plate is fitted longitudinally in the centre of a drum, the stack stays still and the drum rotates through 180° about its longitudinal axis so that the lower edge of the catchment plate is now on the top. The following stack-forming series of boxes falls onto this. A pusher on the side edge presses the two stacks out of the drum simultaneously so that they fall onto each other and together form a compensated packet.

3. A type of carousel turns in the horizontal plane (like a merry-go-round). On four sides (2 by 2 opposite each other) arms are attached on the outside. On these arms is mounted a finger system, between which a stack can be clamped. The stack is held firmly on two opposing sides by the finger system. The held stack can be rotated about its horizontal axis through 180°. The carousel always turns 90° further on each cycle, after two cycles the stack is again deposited and left. In this way unturned and turned stacks are placed on each other, thus forming a compensated packet.
4. A type of carousel turns in the vertical plane (like a windmill). On four sides (2 by 2 opposite each other) are attached arms at the outside. Attached to these arms is a clamping system. When a packet is pushed between these clamps (lying on one of the horizontal vanes) the carousel rotates through 90° (vane is at the top). In this position the clamping system turns about its vertical axis. The carousel turns through a further 90° (horizontal again) and pushes its load on top of an unturned stack already present.

Another embodiment of this turning in the vertical plane is described in U.S. Pat. No. 3,970,202, whereby two box receiving stations are located in vertically spaced planes. Means are provided for turning over a stack of folded boxes deposited in a first station and deposit it in a second station on top of a stack of flat-folded boxes already deposited there.

All these ways of compensating for non-planar stacks, show the disadvantage that compensation either takes a lot of time, or needs a lot of space.

Extra attention must furthermore be paid to the set-up problem. There is an increasing trend towards having less stock. This means that a manufacturer of cardboard boxes gets orders for smaller amounts of boxes to be supplied. As the manufacturer also wants to have a small stock, smaller production series must be made economic. Therefore, modern production machines have small set-up times and maximum output, and all this preferably automated. Manufacturers of folder-gluer machines have made advances towards handling of all kinds of boxes at very high speed. These folder-gluer machines can only have maximum efficiency if the subsequent machines, such as a packeting machine, can also handle the same kinds of boxes at the same high speeds.

It is an aim of the present invention to overcome the problems mentioned above, and to provide a machine which fulfils the market demands as fully as possible. In order to achieve this, the machine should preferably be able to process high throughputs very dynamically and to offer a very flexible system.

It is an aim of the present invention to meet one or more of the following requirements:

The system should be able to output one packet every 5 seconds.

The proposed dimensions are minimum 180 mm×180 mm and maximum 1400 mm×1400 mm.

The system should be able to process the widest possible variety of product forms. This means that compensation of the packets must be possible.

Top- and under-stacking problems should also be handled.

The packets should be guided at all times to prevent unstable packets.

The manual settings should be reduced to a minimum and kept simple so that the total set-up time is always less than 10 minutes.

It is in particular an aim of the present invention to provide a method and a device for making stable packets of flat-folded boxes out of a continuous flow of flat-folded boxes in an overlapping shingled relationship, without stopping the continuous flow.

SUMMARY OF THE INVENTION

The above objectives are accomplished by a machine for production of a stack of stiff flat articles such as flat-folded boxes according to the present invention. The machine comprises an input device for feeding a horizontal flow of stiff flat articles, such as flat-folded boxes in an overlapping shingled relationship, a pusher mechanism for engaging with a side of one of the flat articles and for driving a plurality of flat articles into a vertical stack at a first location, and a transferring device for lifting the stack and transferring it to a second location. The transferring device is adapted to rotate the stack through a predetermined angle between lifting the stack at the first location and transferring it to the second location; preferably the rotation is done about a vertical axis.

According to the present invention, the movement of the pusher mechanism may be controlled in time and place, e.g. by software-based control system, by a hydraulic or pneumatic control system, or, for instance by a control actuator which may be manually operated. Preferably, a control device is provided, such as a computer, a PC, a PLC, an FPGA or any other suitable programmable control device. Preferably the pusher mechanism is actuated so as to make a movement towards the first location which is accelerated with regard to the movement of he horizontal flow of flat-folded boxes. Preferably, it receives a suitable signal or signals from the control device to control the time of starting, the rate of acceleration and when the acceleration should stop. The movement of the pusher mechanism may be controlled in its place or location or in its extent of movement in accordance with a dimension of the flat-folded boxes to be stacked, i.e. the thicker the flat-folded boxes to be stacked, the higher the pusher mechanism will move. This movement is done in accordance with suitable signals received from the control device.

The pusher mechanism may include a bottom-pusher mechanism, which is used in case of top-stacking of the flat-folded boxes, and/or a top-pusher mechanism, which is used in case of under-stacking of the flat-folded boxes. Preferably, both a bottom-pusher mechanism and a top-pusher mechanism are provided on one and the same machine, such that both kinds of shingled flows can be treated with the same machine.

Making a stack out of flat-folded boxes in an overlapping shingled relationship instead of first having to deliver the flat-folded boxes one by one, makes the handling thereof a lot faster compared to previously known machines.

A machine according to the present invention presents short simple set-up times with little but easily accessible safe controls. Flexible means processing of corrugated cardboard boxes in the broadest sense of the word: 4/6-point glued boxes are meant thereby, long seams and crash-lock bottom with widely varying dimensions and forms. Modularity is obtained by dividing the machine into three basic processing units.

The function cycle of the machine per station may be as follows:

The boxes are presented from the drying pressing belt of the folder-gluer to a packeting machine in shingled form. They are counted piece by piece and when reaching a preset quantity they are separated from the rest by an accelerated movement. The stack being formed comes to rest against a stop plate. The first part is called a counter packet collector.

In certain types of boxes a compensation is needed to achieve an easily processable bundle or packet. This is achieved by positioning a first layer (stack) and rotating a second or compensating layer (stack) through −90°, +90' or 180° before placing it on the first layer. This rotation/compensation system preferably comprises a four-axis portal robot with gripper arms.

Once the (compensated) bundle or packet is formed, it can be aligned in an output tunnel. The output tunnel consists of a set of side plates and pushers which move the packet and position it e.g. in a subsequent strapping machine.

The present invention also includes a method for production of a stack of stiff flat articles such as flat-folded boxes, which method comprises the following steps: feeding of a horizontal flow of flat articles in an overlapping shingled relationship; forming of a first stack from a plurality of flat articles at a first location; lifting of the stack and transfer of this to a second location, whereby the stack optionally is rotated through a predetermined angle about a vertical axis between the lifting of the stack at the first location and its transfer to the second location.

The present invention may also provide a counting system for counting flat articles moving in a continuous shingled stream, the system comprising: a fixedly mounted guiding element (23*a*) with a runner (23*b*) for running up the moving shingled stream of flat articles (90), and a rotation encoder connected to the runner.

Other characteristics and advantages of the invention may be seen from the following description of a specific embodiment of the method and installation for stacking flat-folded boxes according to the invention; this description is given for the sake of example only, without limiting the scope of the invention. The reference figures quoted below refer to the attached drawings.

Figure 1:
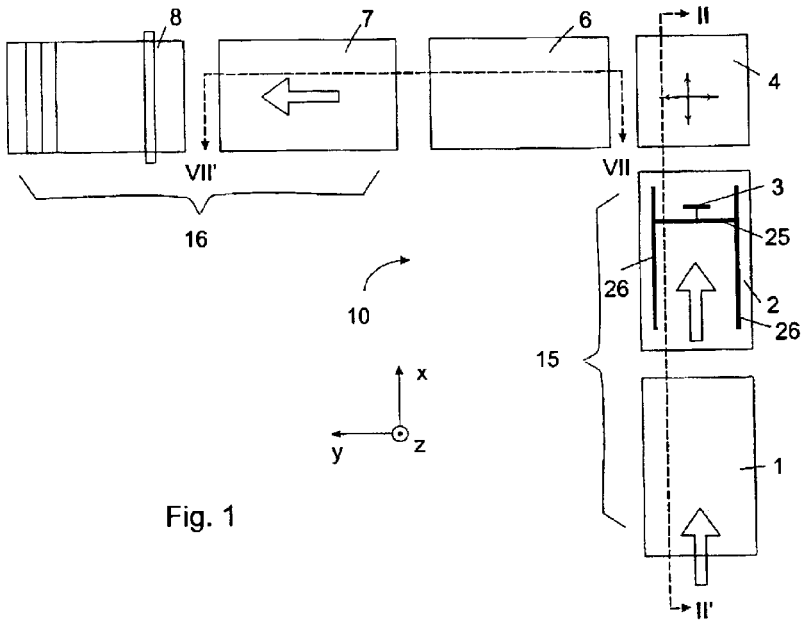
FIG. 1 is a schematic top view of a system according to an embodiment of the present invention, comprising an input section, a portal robot rotation system, a drop-off unit, and an output section.

In the different figures, the same reference figures refer to the same or analogous elements.

DESCRIPTION OF THE ILLUSTRATIVE EMBODIMENTS

The present invention will be described with respect to particular embodiments and with reference to certain drawings but the invention is not limited thereto but only by the claims. The drawings described are only schematic and are non-limiting. The technology needed to realise the various components represented in the drawings is well understood in the delivery systems industry. Many individual structural elements, disclosed in one form, can be embodied in other forms with equivalent operational results. For example, belt systems can be operationally equivalent to roller systems. Actuators can operate electrically or pneumatically. Mechanical systems can be direct-driven by electric motors, or driven remotely through belts and pulleys and activated by electrically or mechanically operated clutches. In the figures some of the support structures are schematically represented, and some are not shown at all to permit a clearer view of the operational elements. Design of such structure is within the capabilities of a competent equipment designer.

A machine 10 for building a packet of flat-folded packing boxes 90 is represented schematically in FIG. 1, and comprises the following major parts:

an input section 15 comprising an input feed 1 and a carriage construction 2, for providing a horizontal stream of flat-folded boxes 90 in an overlapping shingled relationship, a pusher mechanism 3 for engaging with a side of one of the flat-folded boxes 90 and for driving a plurality of the flat-folded boxes 90 into a vertical stack 100 at a first location, a transferring device, such as a portal robot system 4, for lifting the stack 100 and transferring it to a second location 6, the transferring device 4 being adapted to rotate the stack 100 through a predetermined angle between lifting the stack 100 and transferring it to the second location 6, a drop-off point 6 for allowing a packet 200 to be assembled from one or a plurality of stacks 100, and for allowing the packet 200 to be moved to an output section 16, and an output section 16 comprising an output tunnel 7 for aligning the packet 200 and positioning it for a strapping device 8, and the strapping device 8 itself.

Each of those major parts will be separately described hereinafter.

1. Input Section 15

Figure 2:
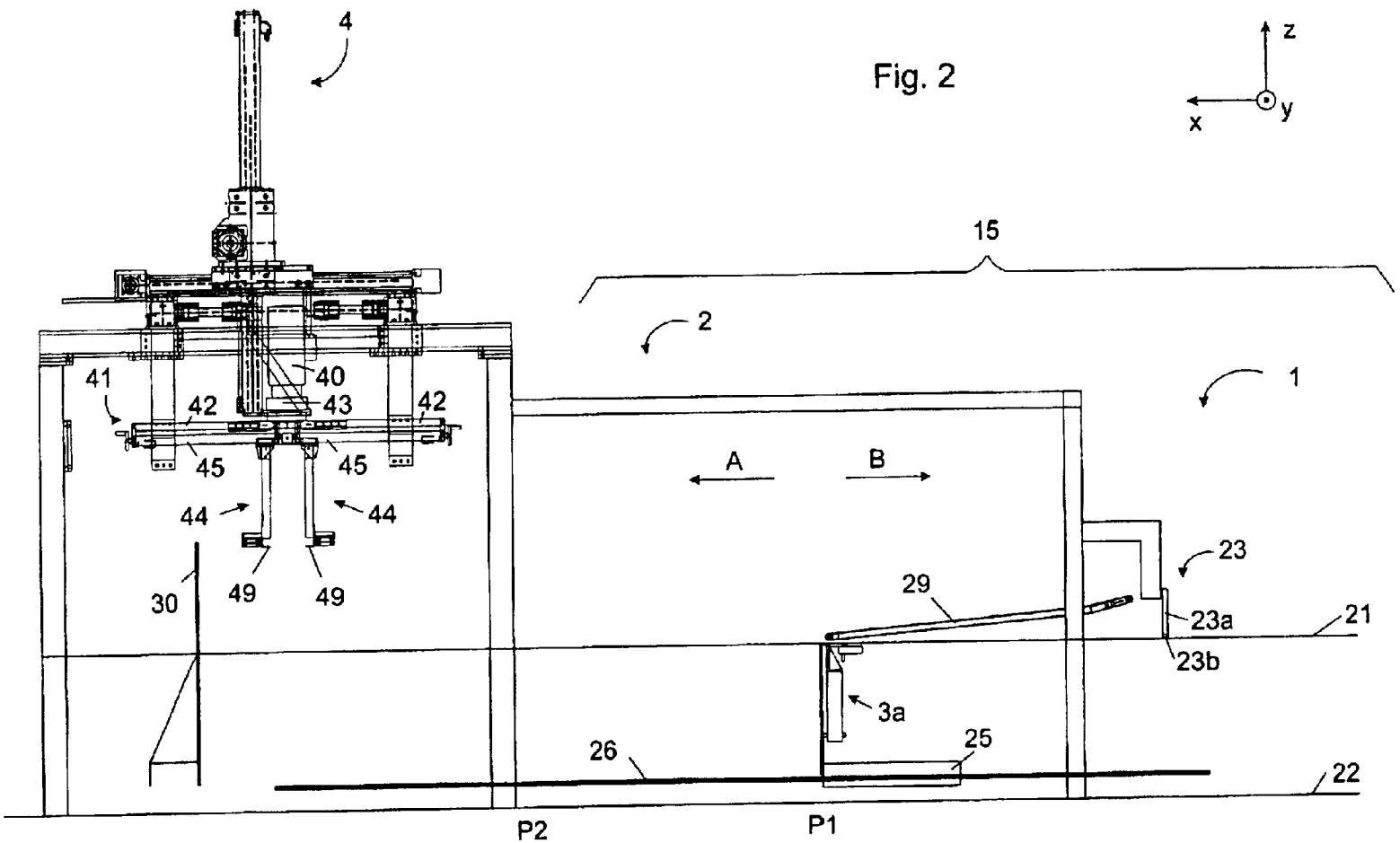
FIG. 2 is a cross-sectional vertical view of the input section and the portal robot rotation system according to line II–II' in FIG. 1.

A shingled stream of flat-folded boxes 90 comes from a pressing band into a counter/stacker machine 10 of FIG. 1 at the input feed 1, and the boxes 90 are therefrom moved on e.g. by synchronous belt transport. FIG. 2 shows a vertical cross-sectional view of the input section 15 and the portal robot system 4, according to the line II–II' in FIG. 1.

Figure 9:
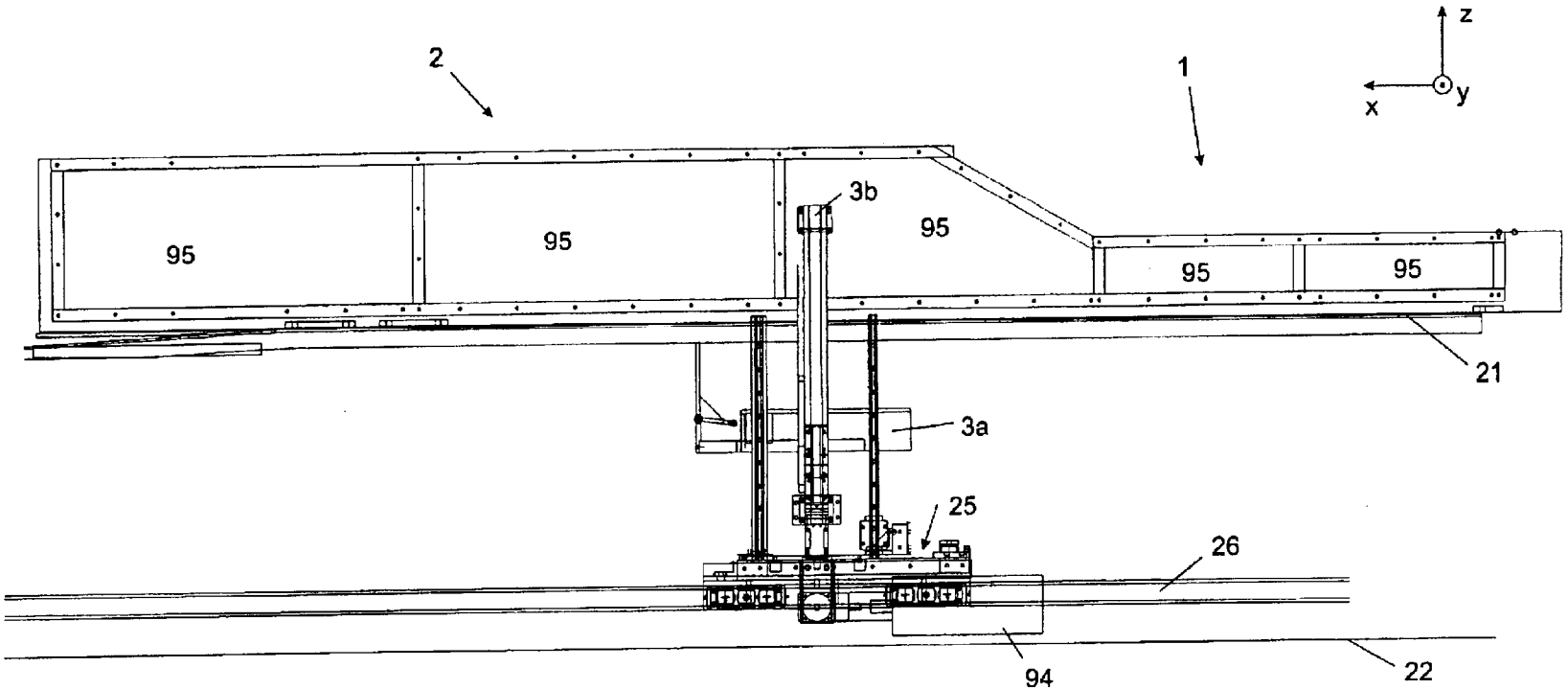
FIG. 9 shows in detail some of the moving parts of the input section in accaordance with an embodiment of the present invention.

At the input feed 1, flat-folded boxes 90 (not represented in FIG. 2) are transported at working level 21, which generally is above floor level 22, under a driven top guide and between side guide plates or a side guide frame 95 (represented in FIG. 9).

The boxes 90 are counted piece by piece by a counting system 23, possibly both at the bottom and top edges of the shingled stream. When a pre-set quantity is counted, the subsequent steps are determined by the method of stacking (top-stacking or under-stacking) of the flat-folded boxes 90 fed in. The counting system 23 used may be any kind of counting system known by a person skilled in the art. However, counting of the shingled boxes 90 in both top-stacking and under-stacking is preferably performed in accordance with an embodiment of the present invention. Counting in both cases may be performed by the same mechanism, the principle of which is based on measurement of a linear movement. In the case represented in FIG. 2, this is done by a light-weight vertically fixed mounted linear guide 23*a* with a runner 23*b* at the bottom which runs up the moving shingled stream of flat-folded boxes 90. The linear guide 23*a* is coupled by means of a plastic rack and pinion (e.g. module 0.5) combination with a rotation encoder (not represented) with resolution of e.g. 1000 pulses per rotation. The runner 23*b* is pushed up by the moving stream of shingled boxes 90. The value of the pulses depends on the vertical position of the runner 23*b*. As each box 90 in the shingled stream is always a significant threshold, after filtering and interpretation, each single box 90 in the shingled stream can be distinguished, and hence counted, with a high degree of certainty.

The output from the rotation encoder is read by a fast counter input of a control device, e.g. a PLC, where the signal is filtered and interpreted before being passed as an actual counted box. For part of the path travelled by the boxes 90, pulse deviations are disregarded (the signal is blinded). This relates to the travelled path of the shingled stream as the boxes 90 are always overlapped by a more or less constant value. For top-stacking, values smaller than the previous one (pulses) are ignored. For under-stacking, values larger than the previous one (pulses) are ignored.

On a sudden rise in pulses, at a subsequent measurement, a minimum quantity (threshold) must have risen in case of top-stacking. On a sudden fall in pulses, at a subsequent measurement, a minimum quantity (threshold) must have fallen in case of under-stacking.

The counting itself is performed at the input feed 1. To present the shingled stream of boxes 90 properly controlled to the counting mechanism 23, also mechanically a few interventions can be carried out in the preferred embodiment described. The part of the feed from the input feed 1 to the pusher 3 may have in the centre a set of extra transport belts with improved grip (not represented).

Above the shingled stream, also a synchronously driven top guide 29 is provided to move the shingled stream of boxes 90 tightly pressed together past the rest position or home position of the carriage construction 2. This top guide 29 is preferably connected mechanically to the belt transport of the device 10. Alternatively, the top guide may receive suitable signals from a control device in order to move synchronously with the belt transport of the device 10.

The shingled stream of flat-folded boxes 90, transported on by the belt transport, moves between the bottom and top parts of the carriage construction 2. The carriage construction, represented in detail in FIG. 9, comprises at least one guide, preferably two guides 26, and possibly more guides, for carrying a carriage 25 which can run on the guides 26 in the direction of and opposite the movement of the shingled flow of flat-folded boxes 90, being the direction indicated as "x" in the drawings. The carriage 25 may be provided with a plate or a platform, or it may be a frame construction. The pusher mechanism 3 is mounted on the carriage 25 and forms part of the carriage construction 2. Said pusher mechanism 3 may comprise a bottom pusher 3*a* and/or a top pusher 3*b*. Even if both a bottom pusher 3*a* and a top pusher 3*b* are mounted at the same time on the carriage 25, only one of the bottom pusher 3*a* or top pusher 3*b* are used at any one moment in time, depending on whether the flat-folded boxes 90 are fed in under-stacking or in top-stacking. The choice of which of bottom pusher 3*a* or top pusher 3*b* is to be driven, is set by an operator, and suitable driving signals, coming from a control device, are sent accordingly to the bottom pusher 3*a* or to the top pusher 3*b*. The bottom pusher 3*a* has moving parts drivable in the vertical direction, i.e. in a direction 90° to the plane in which the shingled stream of boxes 90 moves, being along the z-axis in the drawings. The top pusher 3*b* also has moving parts drivable in the vertical direction, i.e. in a direction 90° to the plane in which the shingled stream of boxes 90 moves, being along the z-axis in the drawings. If the carriage 25 moves in the x-direction, both the bottom pusher 3*a* and the top pusher 3*b* will move with it in the x-direction. The bottom pusher 3*a* and the top pusher 3*b* can furthermore carry out, at the same time as the movement in the x-direction, a movement in the z-direction, which movement is independent or in a pre-set relationship to the movement in the x-direction. Appropriate signals for the vertical movement are sent by a control device.

The entire carriage construction 2 can be moved in the direction of and opposite the movement of the shingled stream of boxes 90, i.e. in the direction of both arrows A and B in FIG. 2. The carriage 25 may e.g. be driven by two toothed belts which run over a pulley with a diameter of e.g. 125.45 mm and a servomotor 94. The carriage construction 2 itself is preferably an aluminium construction with an estimated total weight of 380 kg. It has a fixed home reference (starting position) at location P1, given by an inductive switch. End-of-run inductive switches are also provided. As a mechanical protection, hydraulic shock absorbers are fitted. A front stop position of the carriage 25, being a stop position at a location P2 in the neighbourhood of the portal robot system 4, is calculated by a control device, e.g. a PLC program, from product format data, and is passed to the control device of the motor 94 of the carriage construction 2. Information is preferably exchanged between the control device such as a PLC, and the motor control by Profibus, a vendor-independent family of fieldbus, device-level, and cell controller protocols for use in manufacturing and building automation as well as process control, standardised under the European Fieldbus Standard EN 50 170. It utilises a non-powered two-wire (RS485) network.

A synchronous servo motor 94 preferably drives the carriage 25. It is preferably designed with a resolver so that this always gives its position via feedback. It is possible to use the servo control as a pressure protection for the stop plates 30 so that the motor 94 stops when the cardboard exerts too much pressure on the stop plates 30. This is a protection against incorrect electronic format setting. The motor 94 is also fitted with an external brake so it can be held in its start position (home reference) at location P1.

Figure 4A:
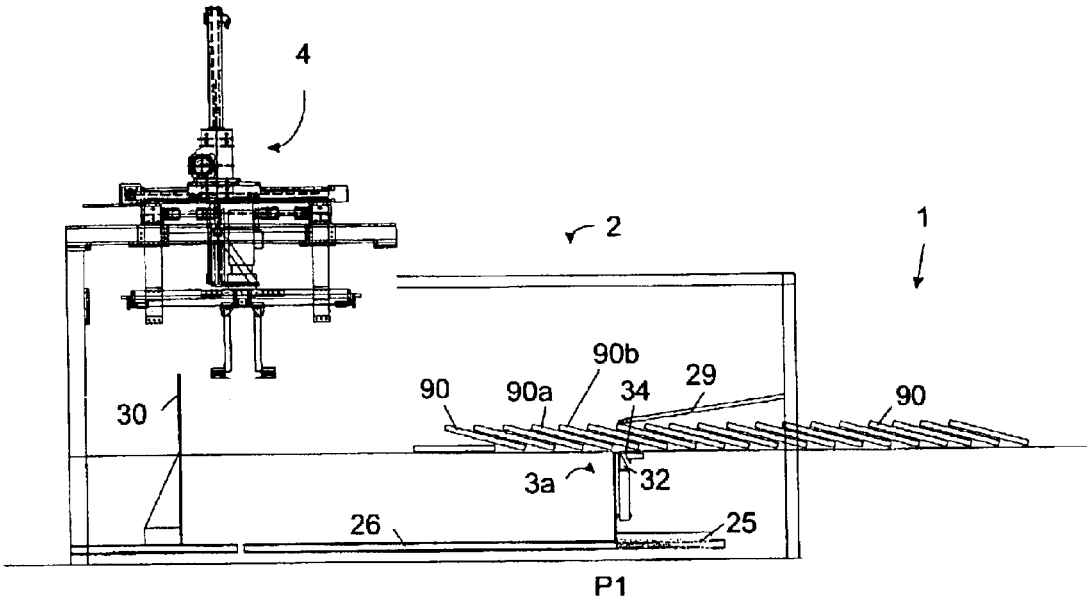
FIGS. 4A–4D show different steps a device for making a stack of flat-folded boxes has to carry out according to a first embodiment of the present invention, whereby the flat-folded boxes are fed in topstacking.

In FIG. 4A, the carriage construction 2 is in its starting position P1.

2. Pusher Mechanism 3

According to an embodiment of the present invention, two different pusher mechanisms 3 are provided: a bottom pusher mechanism 3*a* for use in case the shingled boxes 90 are fed in with top-stacking, and a top pusher mechanism 3*b* for use in case the shingled boxes 90 are fed in with under-stacking.

The bottom pusher mechanism 3*a* as well as different embodiments of the use thereof are described with respect to FIGS. 3A–3D, FIGS. 4A–4D and FIGS. 5A–5E. The top pusher mechanism 3*b* and an embodiment of the use thereof is described with respect to FIGS. 6A–6D.

A first embodiment of the use of a bottom pusher mechanism 3*a* is described in FIGS. 4A–4D. The bottom pusher 3*a* is built in in the construction of the carriage 25. It is a part movable vertically separately from the movement of the carriage 25. This vertical movement is carried out driven by suitable signals received from a control unit, which signals control the timing of the movement and the vertical position of the bottom pusher 3*a*.

The bottom pusher 3*a* preferably is an aluminium construction. The bottom pusher 3*a* is mounted on or suspended from the carriage 25 running on driven guides 26. These linear guides may be e.g. spindle designs with a pitch of 50 mm, and driven by a servo motor 94 with brake. Two end-of-run inductive switches (not represented) are preferably provided, and one extra as a reference switch.

The bottom-pusher mechanism 3*a* is shown more in detail in FIGS. 3A–3D. It comprises at least one pusher, preferably a plurality of pushers, which are upright rods 31 e.g. 40 mm wide. A head 32 of such a rod 31 can move, driven by suitable signals received from a control unit, independently of the pusher rod 31 itself in two directions, vertically, i.e. along the z-axis in FIGS. 3A–3D, e.g. 30 mm above the fixed end of the rod 31, and horizontally, i.e. along the x-axis in FIGS. 3A–3D, e.g. 20 mm ahead of the rod 31, as can be seen in particular in FIG. 3B. In this way a sort of hook 33 is created so that, when the hook 33 is upright and the carriage 25 moves forward, it can reach between the shingled boxes 90 if pushed forward. Also, the trailing one of the shingled boxes 90 can be held tightly by slightly pulling down the hook 33. To increase the result and the chance of placing the hook 33 between two boxes 90*a*, 90*b*, an upwardly moving lip 34 is mounted behind this pusher 3*a* on the fixed part of the construction but at the level of the pusher 3*a*, which lip 34 presses up the shingled flow of boxes 90, more specifically box 90*b*, as can be seen in FIG. 4B.

In FIG. 4A, the carriage construction 2, being the carriage 25 and the bottom pusher mechanism 3*a*, are in their starting positions. The starting position of the bottom pusher mechanism 3*a* is shown more in detail in FIG. 3A. The pusher rod 31 is down and the head 32 is retracted.

Figure 3A:
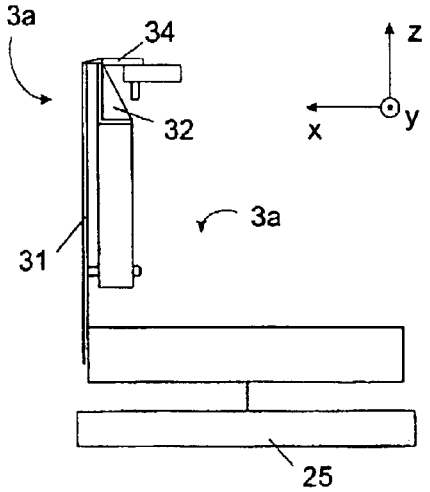
FIGS. 3A–3D are schematic views of different positions of a bottom pusher mechanism during operation according to an embodiment of the present invention.
Figure 3B:
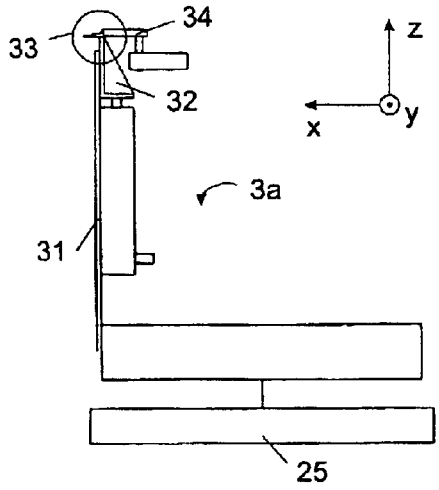
Figure 4B:
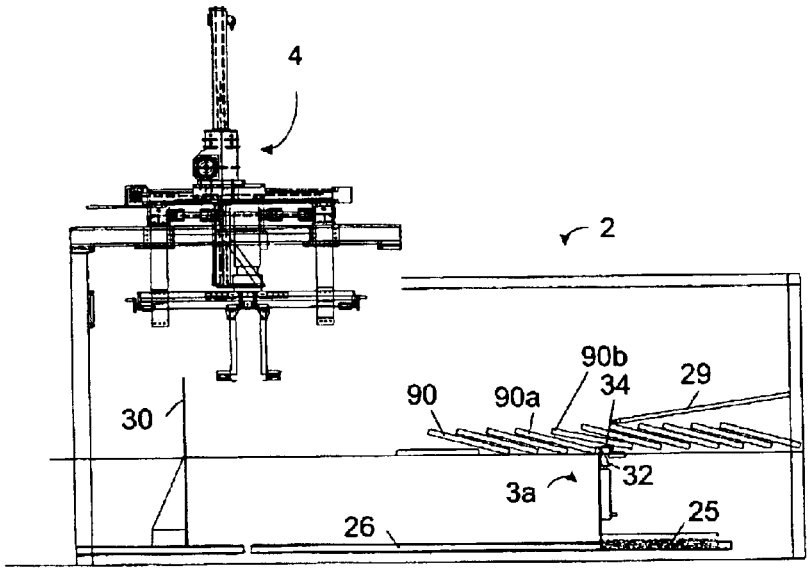

After a predetermined number of shingled boxes 90 have passed the bottom pusher mechanism 3*a*, the lip 34 moves up, as represented in FIGS. 3B and 4B, thus reaching between shingled boxes 90*a* and 90*b*. The head 32 of the bottom pusher mechanism 3*a* moves forwardly and up during a set time period. The carriage 25 moves forward quickly (faster than the movement of the shingled stream), driven by suitable signals received from a control device. By this sequence, a number of boxes are separated from the shingled stream of flat-folded boxes 90, as shown in FIG. 4C.

Figure 3C:
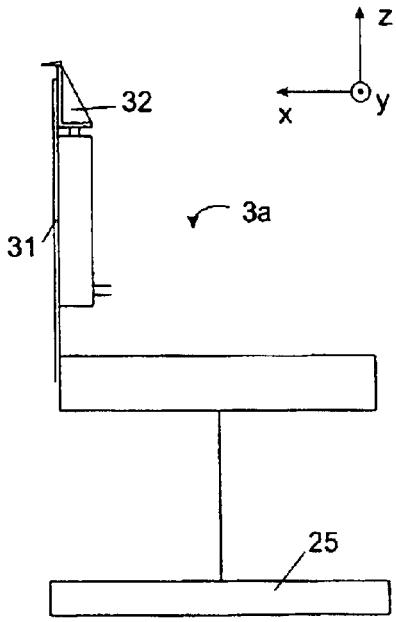
Figure 3D:
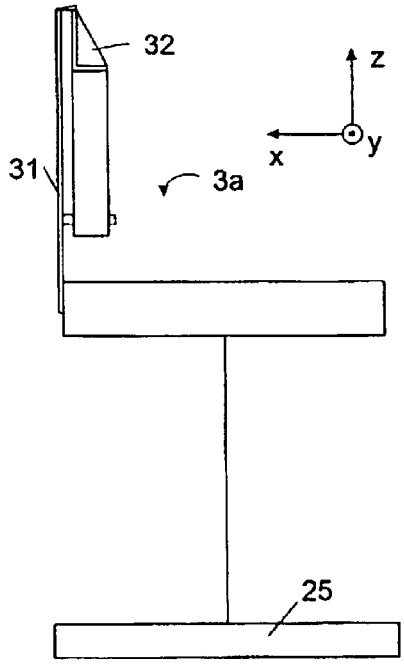
Figure 4C:
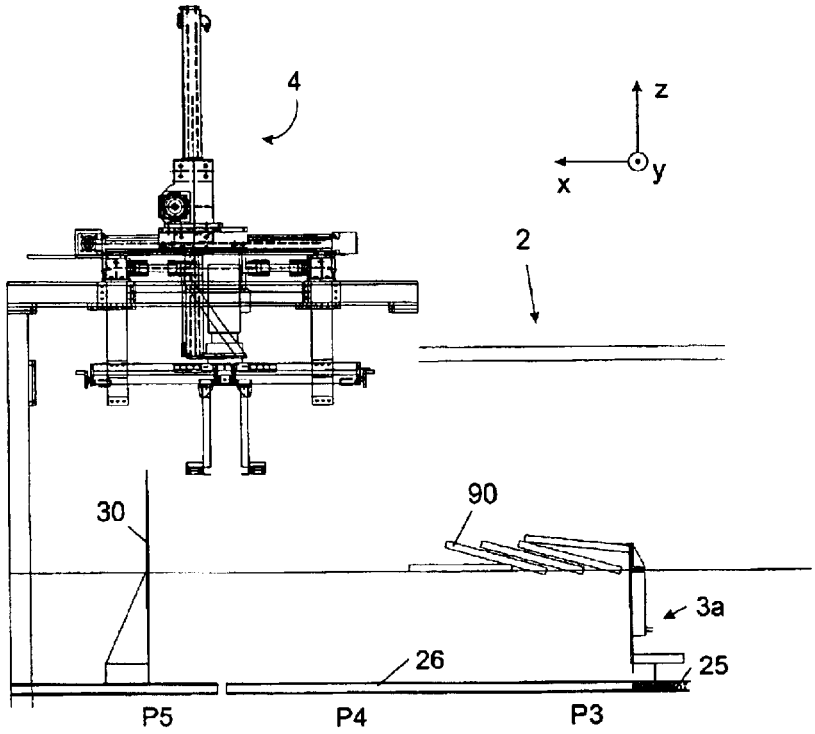

As soon as the bottom pusher mechanism 3*a*, and thus also the carriage 25, has reached a pre-set position P3, the bottom pusher mechanism 3*a* starts moving up with regard to the carriage 25, thus moving in the z-direction, as represented in FIGS. 3C and 4C. This movement is driven by signals received from a control device. The bottom pusher 3*a* is mechanically mounted on the carriage 25 and is movable 90° with relation to the direction of movement of the carriage 25, this being a movement along the z-axis in FIGS. 3A–3D. The upward (in the z-direction) speed of the bottom pusher 3*a* is related to the forward (in the x-direction) speed of the carriage 25 according to a setting (via a menu) which depends on the kind of boxes treated, which setting makes a control device generate suitable signals for driving the bottom pusher 3*a* in upward direction. For example, the upward speed of the bottom pusher 3*a* could be between 5% and 30%, preferably about 10%, of the forward speed of the carriage 25, depending on the format of the boxes 90 treated. The upward speed of the bottom pusher 3*a* can also be higher than 30% of the forward speed of the carriage 25, but should not be too high, in order not to make flat-folded boxes 90 go up too fast, whereafter they will fall down and prevent further stacking. By the combined upward movement of the pusher 3*a*, and forward movement of the carriage 25 on which the pusher 3*a* is mounted, the boxes 90 are taken along, and a stack 100 is being formed.

Figure 4D:
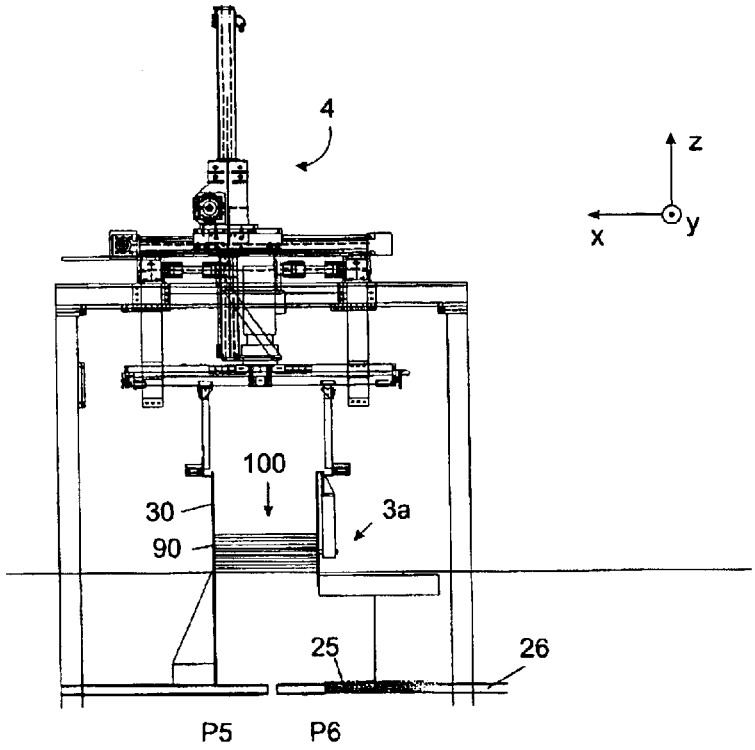

Once the carriage 25 has reached a second pre-set position P4, the bottom pusher 3*a* moves upwards up to end-of-run, independent of the movement of the carriage 25, as shown in FIGS. 3D and 4D. Therefore, the bottom pusher receives suitable driving signals from a control device. In the meantime, the carriage 25 continues moving in the forward direction, being the x direction in FIG. 4D, thus forming a stack 100. The boxes 90 are pushed against one or a plurality of stop plates 30. A neat stack 100 is formed if all flat-folded boxes 90 are pushed between the stop plate(s) 30 and the pusher 3*a*.

The stop plates 30 are positioned, during start-up, at a position P5, and the pusher 3*a* moves forward, carried by the carriage 25, up to a position P6. Position P5 may for example be half a length of a box further than the end-of-run of the pusher 3*a*, in which case the pusher 3*a* moves up to the position "end-of-run minus half a length of a box". Other ways of positioning the stop plates 30 and calculating the position P6 up to where the pusher 3*a* has to move are possible as well. The stop plates 30 can either be positioned manually, or they can be positioned automatically. If the stop plates 30 are positioned automatically, this is done by means of appropriate signals, received by positioning plates driving means (not represented) from a control device.

Along the length of the trajectory described by the flat-folded boxes 90 in FIGS. 4A–4D, guiding plates 95 or a guiding frame (represented in FIG. 9) are preferably provided, at the sides and preferably also at the top of the trajectory. The width between the guiding plates 95 is set manually. The aim of the guiding plates 95 is, next to guiding the flat-folded boxes 90, also supporting the building of the stack 100 by adjusting the friction on the boxes 90 and thus the tension thereon. The setting of the guiding plates 95 is empirical and strongly dependent on the kind of boxes 90 stacked.

FIGS. 5A–5E show a second embodiment for stacking, according to the present invention, flat-folded boxes 90 fed in top-stacking. In this embodiment, during start-up, the stop plates 30 are positioned on a position P7 depending on the length of the boxes 90 to be stacked, which position P7 is not under the portal robot system 4, contrary to the embodiment described in FIGS. 4A–4D. The aim of positioning the stop plates 30 at position P7 is to make stacks 100 from two sides at the same time, and to prevent the boxes on top of the forming stack to slide away.

Figure 5A:
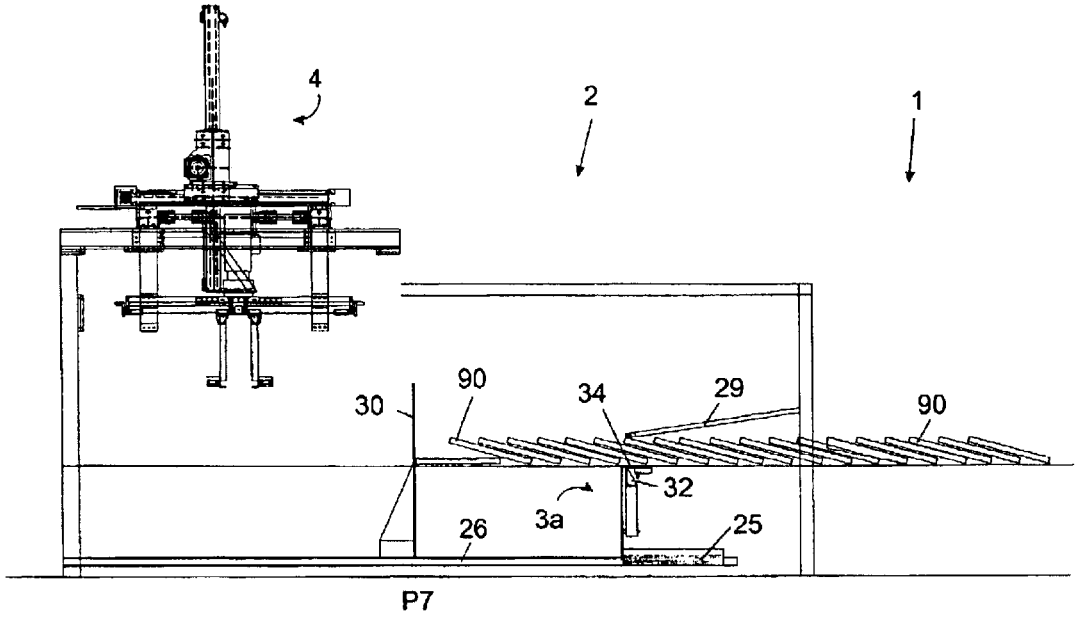
FIGS. 5A–5E show different steps a device for making a stack of flat-folded boxes has to carry out according to a second embodiment of the present invention, whereby the flat-folded boxes are fed in topstacking.

In FIG. 5A, the carriage 25 and the bottom pusher mechanism 3*a* are in their starting positions. The starting position of the bottom pusher mechanism 3*a* is shown more in detail in FIG. 3A, and has been described above.

Figure 5B:
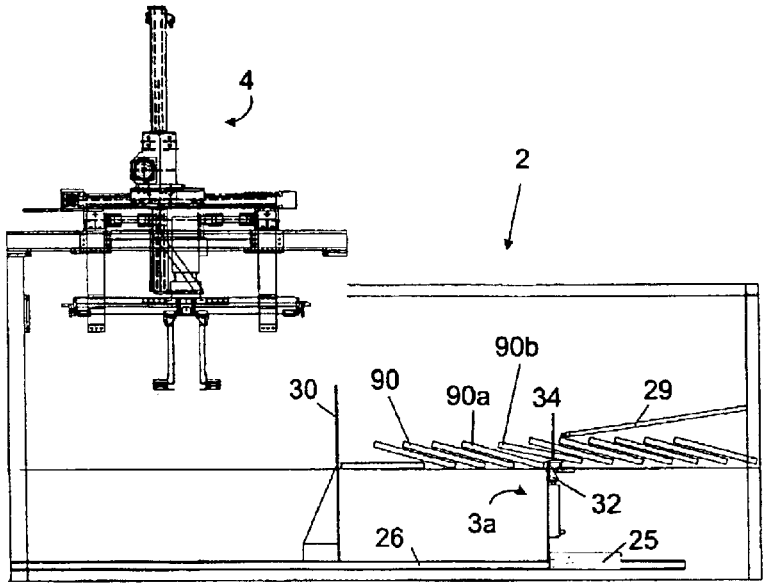

After a predetermined number of shingled boxes 90 have passed the bottom pusher mechanism 3*a*, the lip 34 moves up, as represented in FIGS. 3B and 5B, thus reaching between shingled boxes 90*a* and 90*b*. The head 32 of the bottom pusher mechanism 3*a* moves forwardly and up during a set time period. The carriage 25 fastly moves forward (faster than the movement of the shingled stream). The movement of the bottom pusher mechanism 3*a* is driven by suitable signals received from a control unit. By this sequence of forward and upward movement, a number of boxes is separated from the shingled stream of flat-folded boxes 90, as shown in FIG. 5C.

Figure 5C:
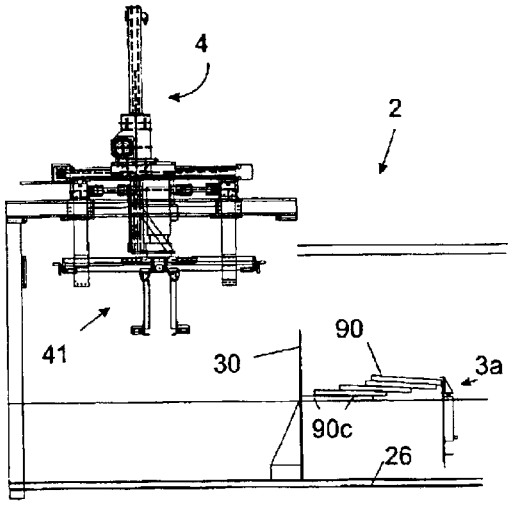

As soon as the bottom pusher mechanism 3*a*, and thus the carriage 25, has reached a pre-set position P3, the bottom pusher 3*a* starts moving up, as represented in FIGS. 3C and 5C, driven by suitable signals received from a control device. The bottom pusher 3*a* is mechanically mounted on the carriage 25 and is movable 90° with relation to the direction of movement of the carriage 25, this being a movement along the z-axis in FIGS. 3A–3D, where the carriage 25 is movable along the x-axis. The speed of the bottom pusher 3*a* is related to the speed of the carriage 25 according to a setting (via a menu) which depends on the kind of boxes treated. By the combined upward movement of the pusher 3*a*, and forward movement of the carriage 25 on which the pusher 3*a* is mounted, the boxes 90 are taken along, and a stack 100 is being formed. By the combination of the movements of the pusher 3*a* and the carriage 25, the lowermost boxes 90*c* of the stream push against the stop plates 30; therefore stack-forming also takes places in the lowest layers, and not only in the uppermost layers as is the case in the embodiment described with relation to FIGS. 4A–4D.

Figure 5D:
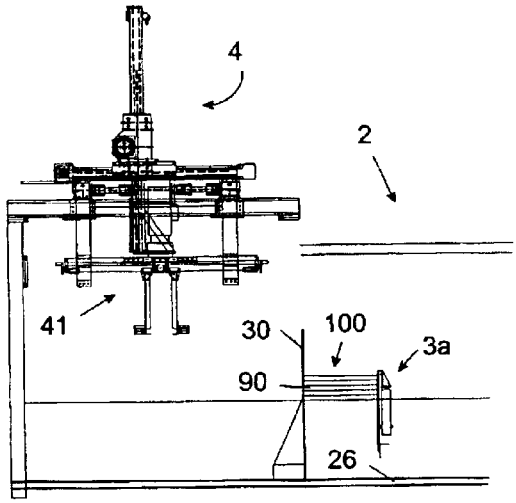

The bottom pusher 3*a* moves upwardly driven by suitable signals received from a control device, up to when it comes a little higher than the total height of the stack 100 to be formed, as represented in FIG. 5D. This is a difference with the first embodiment, where the pusher 3*a* moved upwardly up to end-of-run. The advantage of this is that the uppermost flat-folded boxes 90 are less taken along upwardly by the bottom pusher 3*a*, and that there are thus less chances that one or more boxes are taken up and fall down again, which makes it impossible to further stack the boxes.

Figure 5E:
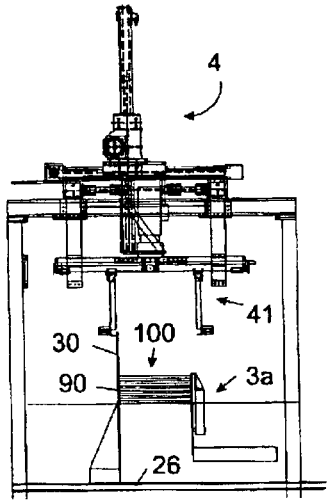

Once the pusher 3*a* is at a pre-set distance from the stop plates 30, which distance equals the length of the boxes 90, the stop plates 30 start to move as well, and move synchronously with the pusher 3*a*, driven by suitable signals received from a control device, until the centre of the stack 100 is positioned under the centre of the gripper head 41 of the portal robot system 4, as represented in FIG. 5E. In practice, the stop plates 30 start moving a bit earlier to limit the acceleration of the stop plates 30. Synchronisation is then done when the distance between the stop plates 30 and the pusher 3*a* equals the length of the boxes 90.

In this embodiment again, preferably guiding plates 95 are provided along the path of the boxes 90, as for the first embodiment.

The carriage 25 is designed so that in case of top-stacking, the shingled stream is split and the stack 100 is formed by combining a horizontal and vertical drive. The carriage 25 moves forward while the bottom pushers 3*a* mounted thereon or suspended therefrom move upward. In the meantime a pressure system, moving in synchrony with the belt transport, holds the stack 100 under control on the top edge.

A third embodiment is described with relation to FIGS. 6A–6D, and shows how boxes 90 are stacked if they are fed in under-stacking. In order to deal with this kind of feed, a top pusher 3*b* is built in the construction of the carriage 25. The top pusher mechanism 3*b* is an aluminium construction fixedly suspended on upright parts of the carriage located on either side of this carriage 25.

The top pusher mechanism 3*b* is integrated in the carriage construction 2 and forms part thereof. The pushers 35 of the top pusher mechanism 3*b* themselves are a plurality of rods. In operation they are always between the side plates or guiding plates 95, and together they can move over the width of the machine 10, which lays in the y-direction in the drawings. A pneumatically driven piston rod (not represented) ensures that the pusher 35 can be moved a fixed distance forward or backward, i.e. in the direction of arrows A, respectively B in FIG. 6A. The piston rod is driven by suitable signals received from a control device. By this movement, the top pusher 3*b* can be brought to its start or rest position, being position P1 in FIG. 6A.

Figure 6A:
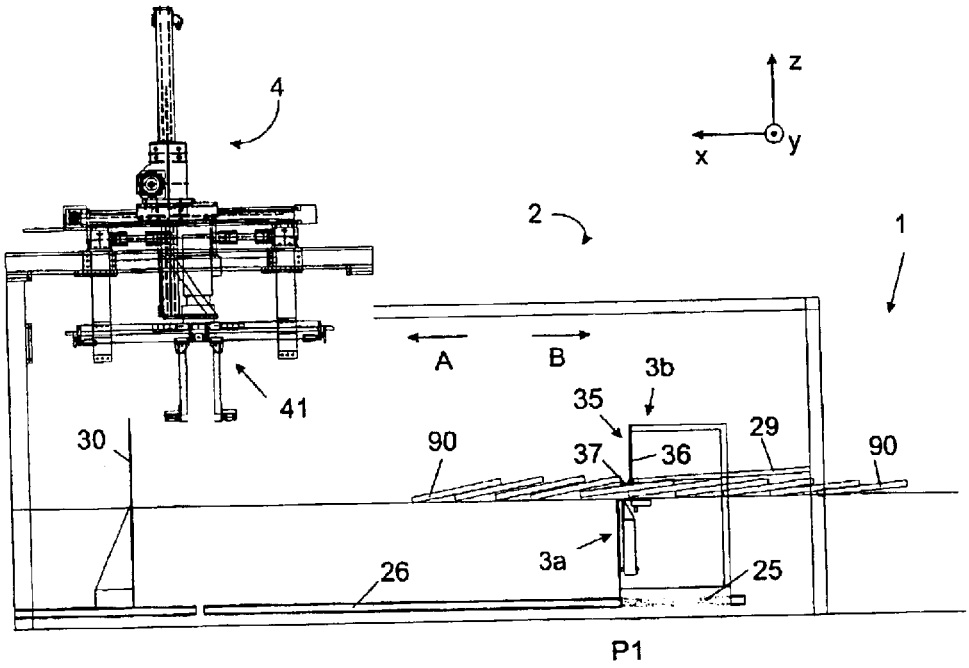
FIGS. 6A–6D show different steps a device for making a stack of flat-folded boxes has to carry out according to a third embodiment of the present invention, whereby the flat-folded boxes are fed in understacking.
Figure 6B:
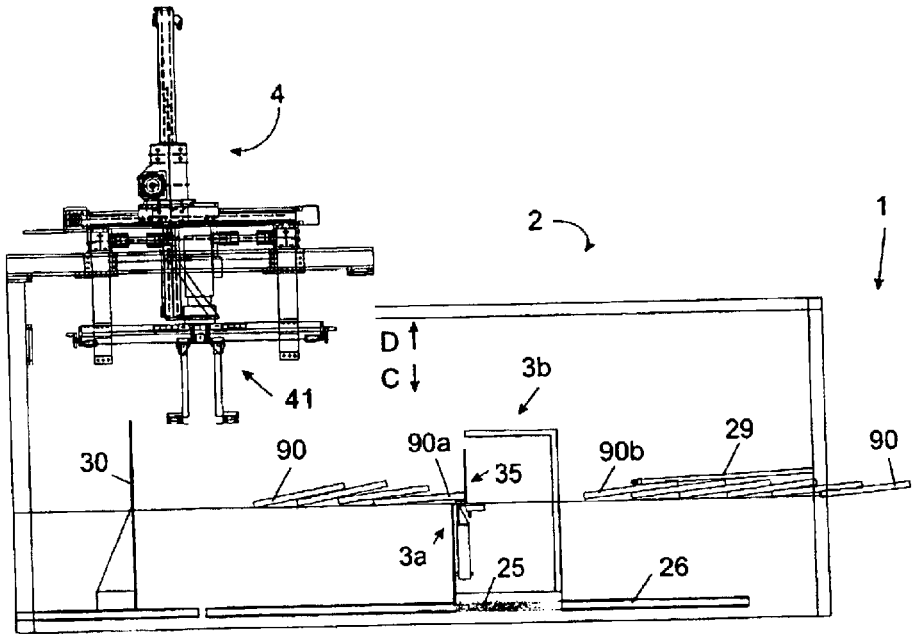

In the start position P1, if a pre-set number of flat-folded boxes 90 have passed the top pusher 3*b*, the pushers 35 must move a fixed distance down in order to push off the shingled boxes 90, as represented in FIG. 6A. The actual pushing off itself is performed by, meanwhile, moving forward the carriage 25, carrying the top pusher 3*b* and thus the pushers 35 with it, while the pushers 35 are moving down, i.e. in the direction of arrows C, as can be seen in FIG. 6B. To guarantee the safe function of the pushers 35, a minimum distance from the centre of the machine 10 must be observed. There is also provided a mechanical stop. To detect the position of the movements, IN and OUT sensors are preferably provided. If this mechanism is not used, the pushers 35 must be moved apart as far as possible from the centre of the machine 10, which is first moved to the rest position. For safety reasons, a reference position sensor is preferably fitted in the position to which the mechanism must be moved, otherwise the machine will not function.

Figure 6C:
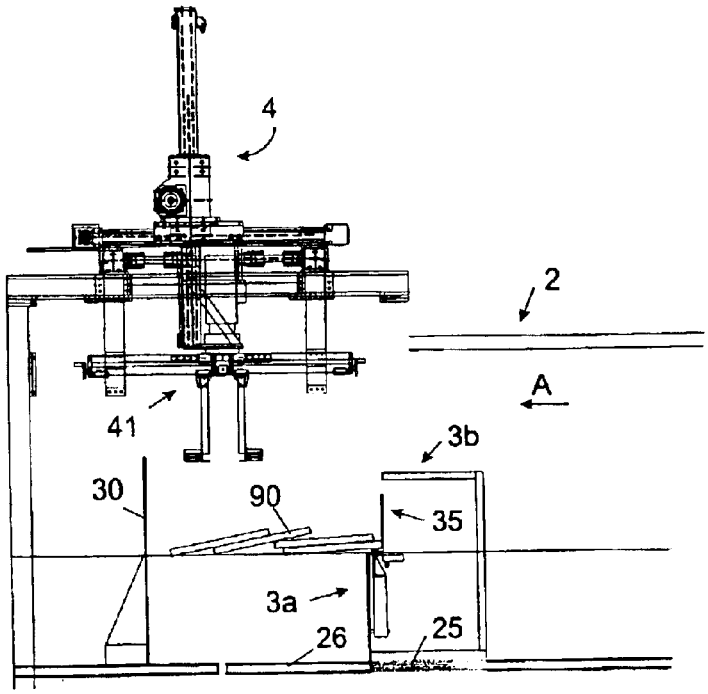

The top pusher 3*b*, and thus also the pushers 35, are moved further forward, in the direction of arrow A, driven by suitable signals received from a control device, as represented in FIG. 6C, thus beginning to build a stack of the flat-folded boxes pushed off.

During forward movement of the carriage 25, preferably a pressure system is used to hold the rest of the boxes 90 to prevent twisting by friction forces. This is preferably done by pressing a plate (not represented) on the top of the boxes to be stacked. To prevent blocking and hence accumulation of the flat-folded boxes 90 already supplied, this plate moves with the boxes 90 while pressing. The pressure plate is moved down by a pneumatically driven piston rod which is driven by suitable signals received from a control device. To set the pressure level for the pressure plate, in first instance the position of the OUT sensor is used. Several OUT sensors therefore are fitted. The forward movement of the pressure plate in synchrony with the belt transport may e.g. be performed by a linear shaft with toothed belt drive, the carriage of which stands still and the shaft moves. This shaft is moved by a servo motor. Thanks to a resolver and associated servo control, the position of the pressure plate in the horizontal plane is known at all times. On the shaft are provided two end-of-run inductive switches and one reference switch. The position of the pressure plate in the vertical plane is determined by the IN and OUT sensors of the piston rod.

Figure 6D:
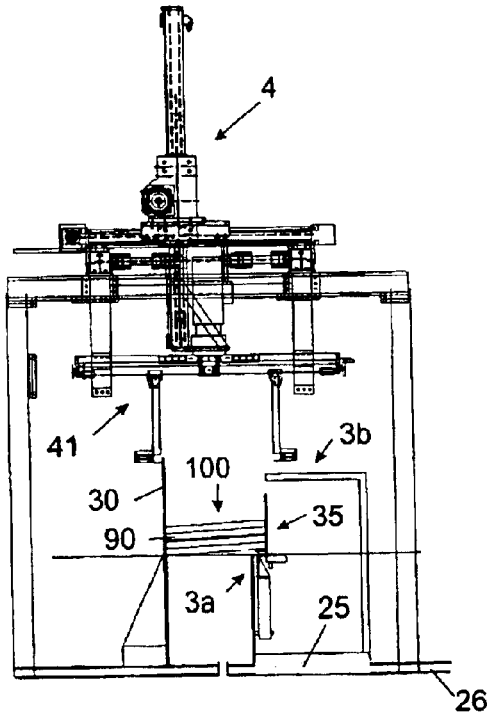

The carriage 25 finally brings the forming stack to rest against a rear stop plate 30 or a plurality of rear stop plates 30 using positioning control (a servo motor and a control device for controlling the feed of the carriage 25), as represented in FIG. 6D. This plate or these plates 30 can be set to a correct position using a servo motor. In semi-automatic function this plate or these plates 30 can be moved pneumatically downward so the stack 100 can be manually removed. These pneumatic rod-less cylinders can indicate their up or down position by IN and OUT Reed relay sensors.

According to a fourth embodiment (not represented), if there is sufficient space between two flat-folded boxes 90*a* and 90*b*, as shown in FIG. 6B, the bottom pushers 3*a* move up and take over the packet formation from the top pushers 3*b*. The top pushers 3*b* are raised and retracted again (moved in the direction of arrow B in FIG. 6A). A pressure system which moves synchronously with the belt transport has the same function as in top-stacking.

The width position of the top pushers 3*b* can be set manually. The pressure plate pneumatic cylinder has several Reed relay sensors so its approximate position is known. By choosing one of these sensors as the end sensor, the height of the pressure plate is determined.

3. Transferring Device 4

A stack 100, transported by the carriage construction 2 towards a first location, is lifted and transferred to a second location, either rotated in a horizontal plane or not. This is represented in FIGS. 7A–7F and FIGS. 8A–8B. The transferring device 4 itself is shown in detail in FIG. 10.

Figure 10:
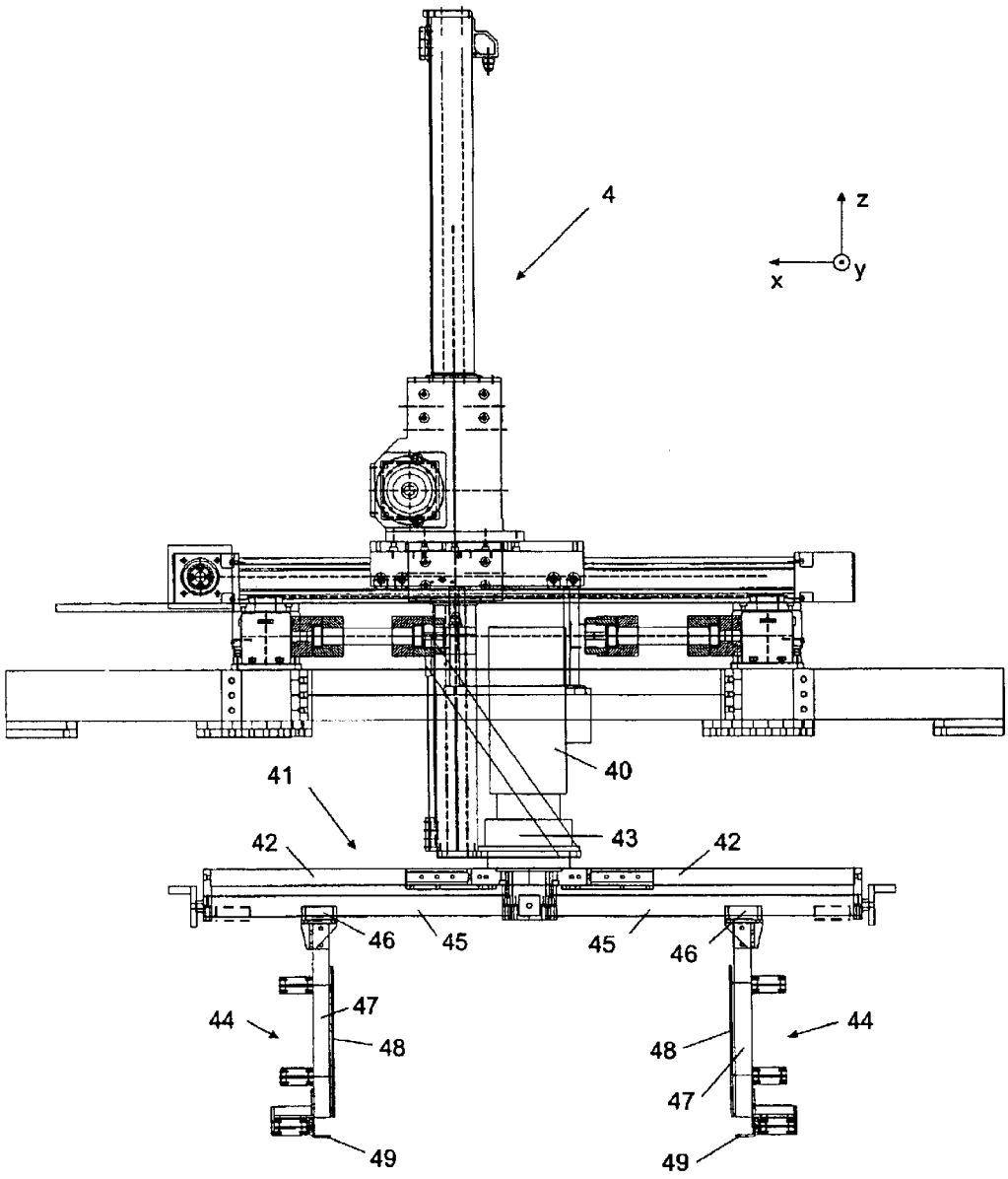
FIG. 10 is a detailed view of the gripper head of the portal robot system according to an embodiment of the present invention.

The transferring device is a 4-axis (X-Y-Z-Θ) portal robot system 4 with a gripper head 41, represented in FIG. 10. All linear axes are driven linear units parallel to each other. This is to allow movement of a heavy load at a high speed with a relative repeat accuracy (±1 mm). Movements over all axes are controlled by a servo motor 40 receiving suitable signals from a control device. For movement in the direction of the Z-axis, a servo motor 40 with brake is provided. The rotation about an angle Θ is performed with a special planetary reducing gear 43 with a large outgoing shaft diameter. On the X-Y-Z axes are provided inductive end-of-run switches and a reference switch. The most critical movement here is the movement according to the Z-axis, as this movement must reach a minimum height before the other axis movements can begin. The gripper head 41 of the transferring device 4 can safely move its load over the stop plates 30 and possible other obstacles. Therefore a secondary sensor, e.g. an inductive sensor or a photocell, is preferably placed to mark the height independently of the servo control. The rotation angle is best marked in relation to a reference point (0°, 90°, 180°, −90°). The reference point is preferably equal to the zero point (0°).

The positioning of the axes is determined by a control device, e.g. a PLC program, from product format data, and is passed to control of the motor 40. Information is exchanged between the control device such as the PLC, and the motor control e.g. via Profibus.

The transferring device 4 has a gripper head 41 comprising a horizontal supporting construction with 4 aluminium arms 42, bars of e.g. 160×40 mm which are placed over each other in a cross shape, the centre of which is mounted on a special rotating reducing gear 43. Under each arm 42 is fitted a guide profile 45, the positioning carriage 46 of which is moved thereon e.g. by means of a spindle, driven by suitable signals received from a control device. Mounted at the bottom on these positioning carriages 46 hang the actual gripper arms 44. These consist of three parts: a supporting part 47, side plates 48 and fingers 49. The eight fingers 49, two on each side, are extended and retracted by pneumatic piston-rod cylinders driven by suitable signals received from a control device. The side plates 48 of the gripper arms 44 are made to extend and retract pneumatically by 20 mm to give more play on the four sides around an assembled stack 100. To minimise the slippage of the suspended boxes, on the rear gripper arm 44 is placed a vertically freely mobile linear guide with a weight at the bottom. When the gripper head 41 moves down, this weight presses automatically on the front edge of the stack 100 of boxes.

The four gripper arms 44 can be moved independently by the spindle receiving suitable driving signals from a control device. However, the position of a gripper arm 44 is relatively critical. These settings are automated, based on the principle of a docking station. One DC positioning motor with a special coupling interface to the gripper spindle ensures the setting positions, one by one, of the gripper arms 44. The gripper head 41 is always brought to position towards a positioning interface.

The rotation of any stack 100 of boxes requiring compensation is performed in the horizontal plane using the special rotating reducing gear 43 in the centre of the gripper head construction 41.

Figure 8D:
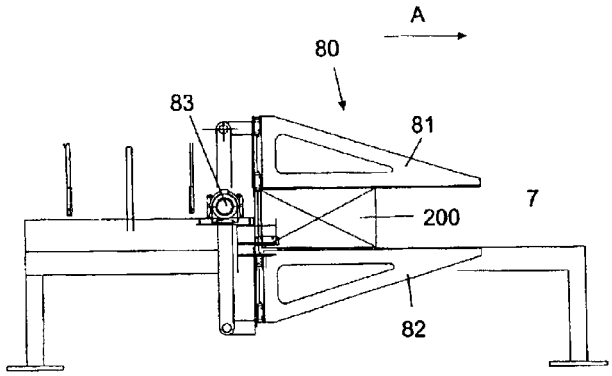
FIGS. 8A–8E show different steps a rotation/compensation system has to carry out for moving a stack of boxes from a first location towards a second location, according to a second embodiment of the present invention.
Figure 8E:
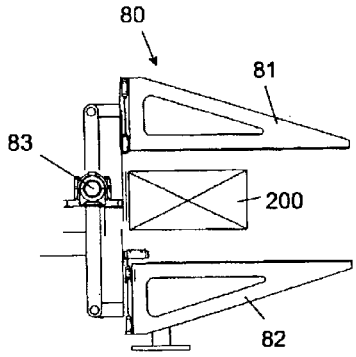
Figure 7A:
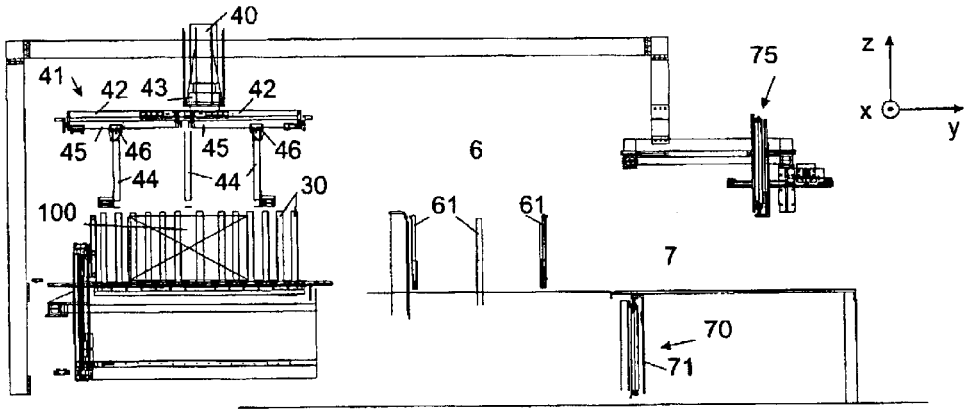
FIGS. 7A–7F show different steps a rotation/compensation system has to carry out for moving a stack of boxes from a first location towards a second location, according to a first embodiment of the present invention.
Figure 7B:
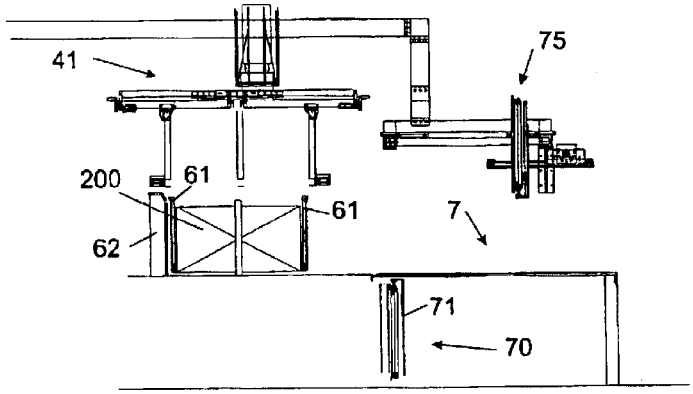
Figure 8A:
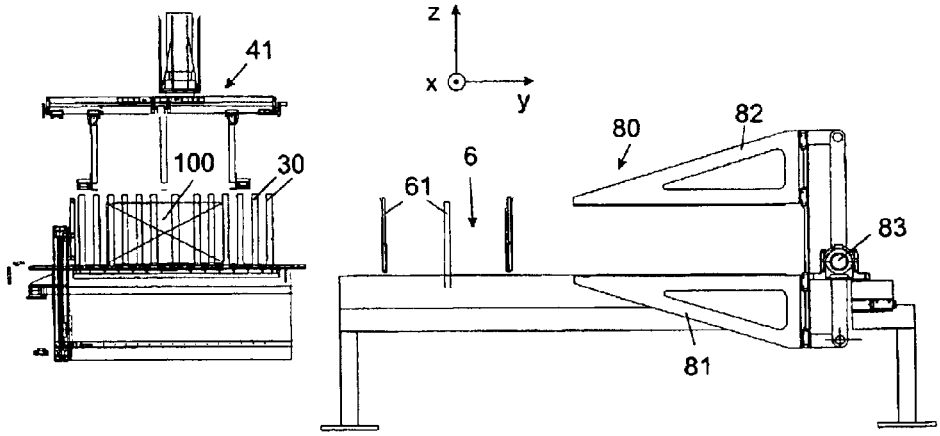
Figure 8B:
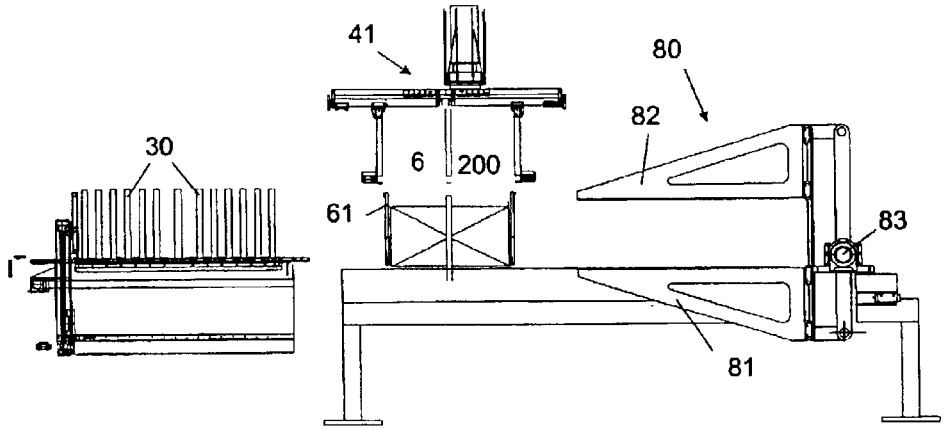

In FIG. 7A and in FIG. 8A, a stack 100 of boxes is ready at a first location. The gripper head 41 will go down. The gripper arms 44 will close, driven by suitable driving signals received from a control device, and thus embrace the stack 100 of boxes. Once the gripper arms 44 are closed, the gripper head 41 is lifted again, and the stack 100 is moved towards a second location, the drop-off point 6, where the stack 100 is deposited, as represented in FIG. 7B and FIG. 8B. During this movement towards the second location, the gripper head 41 can rotate about an angle, driven by appropriate signals received from a control device, in order to put the stack 100 of boxes rotated over 90°, 180° or −90° on top of a stack already present at the drop-off point 6, thus forming a compensated packet 200.

4. Drop-Off Point 6

The drop-off point 6 is provided to allow secure turning and depositing of the individual stacks 100. Manual setting of width bars 61 allow the stacks 100 to have a correct support, depending on the dimensions of the flat-folded boxes 90 in the stack 100. Angle profiles can be moved manually in longitudinal direction. The stacks 100 of boxes are centred in this way. In FIGS. 7B and 8B, the gripper head 41 has put the stack 100 of boxes on the drop-off point 6, driven by appropriate signals received from a control device. The gripper head 41 can now return to its home position. A compensated packet 200 is formed at the drop-off point 6, ready for being strapped.

A push system 62 is performed with a pneumatically controlled top clamp (IN-OUT sensors) so a compensated packet 200 is pushed in the direction of an output tunnel 7. The push system 62 is preferably driven by a servo motor receiving suitable driving signals from a control device. End-of-run switches are provided. The position of the pusher 62 at the front (start position) is calculated by the control device, e.g. a PLC program, from product format data, and is passed to the motor control. This pusher 62 can also be used to prevent the packet 200 from slipping. This positioning method can also be used at the back but the end position is a fixed position, as the end of the output tunnel is at a fixed position. Information is exchanged between the control device, e.g. a PLC, and the motor control, e.g. via Profibus. A hydraulic shock absorber is provided as mechanical protection. At the back a pillar can be twisted pneumatically away from the two corners (IN-OUT sensors) so that the way is clear to bring the packet 200 to the output tunnel 7. Once again in supply and possible rotation of the packet 200 by the rotation system, the Z-axis position is critical so here too it is best to fit a height marker sensor.

The drop off bars 61 are pneumatically moved 50 mm up and down so that during the deposit process, the fall height of a stack 100 is reduced.

A clamp on the drop-off pusher 62 may be omitted and instead two stainless steel side plates may be fitted on the mobile suspension of turning gates so that a packet 200 can be held between two upright plates during movement of the drop-off pusher 62 towards the output tunnel 7.

Figure 7C:
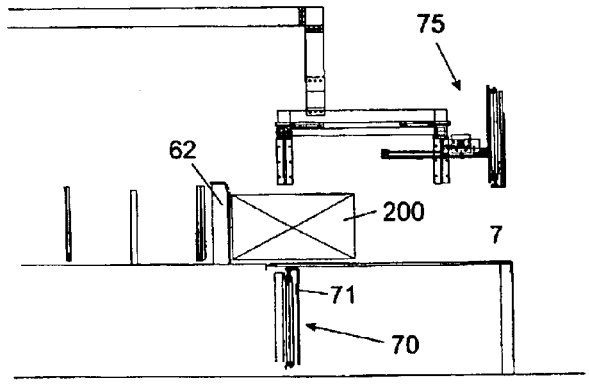
Figure 7D:
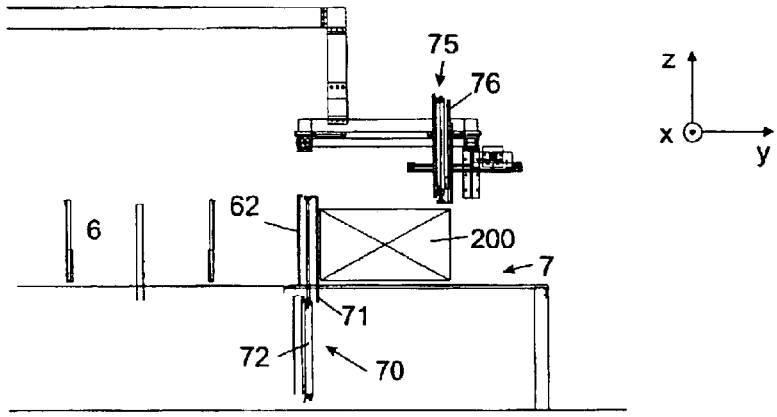

The packet 200 is pushed by the drop-off pusher 62 towards an output tunnel 7, as represented in FIG. 7C. In FIG. 7D, the drop-off pusher 62 has reached its end position. A pusher 71 of an output system 70 goes up to take over the pushing movement from the drop-off pusher. The drop-off pusher 62 can move back to its home position. The pusher 71 of the output system 70 can move forward, i.e. in the Y-direction on FIG. 7D, thus moving the packet 200 further through the output tunnel 7.

According to another embodiment, as represented in FIG. 8B, once the gripper head 41 has deposited the stack 100 and the packet 200 is formed at the drop-off point 6, a gate of the drop-off point 6 opens. A pair of packet tongs 80 drives in the drop-off point 6. The pair of packet tongs 80 comprises a lower tong half 81 and an upper tong half 82. The distance between the lower tong half 81 and the upper tong half 82 can be set in function of the height of the packet 200, for example between 115 mm and 1400 mm, and this setting is driven by suitable signals received from a control device. The lower tong half 81 can only move over a small distance, and has as principal aim to lift the packet 200 over the drop-off point 6. The upper tong half 82 is the clamping part of the pair of packet tongs 80. This upper tong half 82 is pressure controlled to adjust the clamping force.

Figure 8C:
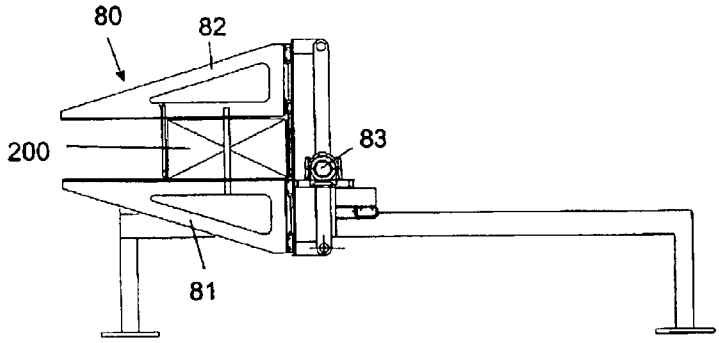

Once positioned to enclose the packet 200, the lower tong half 81 is lifted, to lift the packet 200 over the drop-off point 6. Thereafter, the upper tong half 82 closes to clamp the packet 200, as represented in FIG. 8C.

Thereafter, the pair of packet tongs 80 rotates 180° about a rotation point 83, as represented in FIG. 8D, and starts a forward movement.

5. Output Section 16

The output section 16 of the embodiment described comprises an output tunnel 7 and a strapping device 8.

Figure 7E:
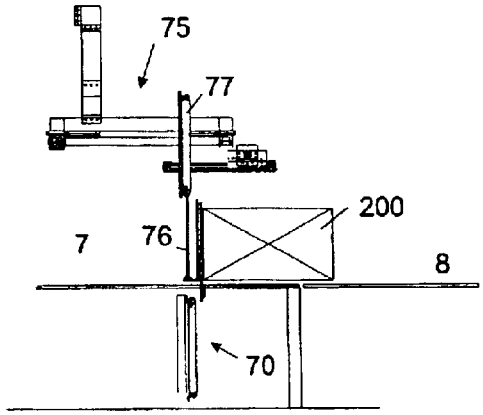
Figure 7F:
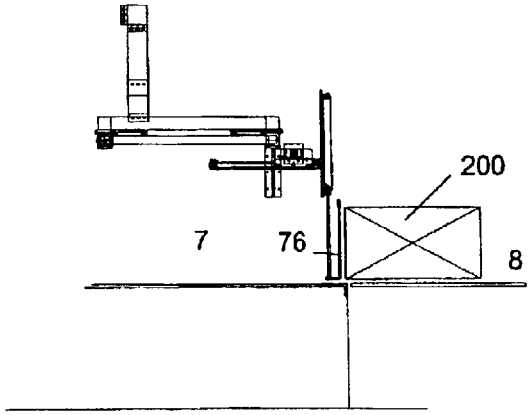

For the first embodiment, described in FIGS. 7D–7F, the output tunnel 7 is formed by manually set side plates (not represented) and preferably has a top guide (not represented) with manual height adjustment. Behind the packet 200, pushers 71 (fitted with IN-OUT sensors) are pushed up by a pneumatic piston rod 72, driven by suitable signals received from a control device. The forward movement of the pushers 71 in the direction of the strapping device 8 is performed using a servo motor with end-of-run switches. The positioning of the pushers 71 is calculated by the control device, e.g. a PLC program, from product format and bundling data, and is passed to the motor control. Information is exchanged between the control device, e.g. the PLC, and the motor control e.g. by Profibus.

Once the output system 70 has reached its end position, as shown in FIG. 7E, an expel system 75 takes over the moving of the packet 200. The output system 70 can go back to its home position in the mean time. The pusher 76 of the expel system 75 is moved down behind the packet 200 by a pneumatically driven piston rod 77 receiving suitable signals from a control device. The forward movement is e.g. performed by a linear shaft with toothed belt drive, where the carriage is fixed and the shaft moves. This shaft is moved forward by a servo motor receiving appropriate driving signals from a control device. By using a resolver and associated servo control, the position of the expel pusher 76 in the horizontal plane is known at any time. On this shaft are two end-of-run inductive switches and one reference switch. The position of the expel pusher 76 in the vertical plane is determined by the IN-OUT sensors of the piston rod.

The expel system 75 can set the packet 200 on a position where strapping can be done by a strapping device 8, as represented in FIG. 7F, or it can move the packet 200 out of the machine 10, e.g. towards a palletising unit (not represented) where different packets 200 are stacked.

The expel system 75 has as most important advantage a time saving, especially when strapping is used: while the expel system 75 is doing its job, the output system 70 can go back to its home position.

Preferably guiding plates (not represented) are provided along the expel system 75 for guiding the packets 200 and for providing some friction in order to avoid that packets 200 fall to pieces due to accelerations or decelerations of movements. The guide plates can be set manually.

The pushers 71, 76 of the output section 16 must be switched on and off automatically. For this an analog photocell is placed on the side to detect the distance of the side plate from its maximum or minimum position. All pushers which fall under and outside these side plates (side plate detection output) are switched off. A manual adjustment furthermore also allows disconnection of the pushers 71, 76 between the side plates.

For the second embodiment, shown in FIGS. 8D–8E, the pair of packet tongs 80 moves through the output tunnel 7. At the end thereof, the pair of packet tongs 80 can drive into a strapping machine 8 (which in this case must be a special kind of strapping machine) and have the packet 200 strapped. Once this has been done, or once the pair of packet tongs 80 is at the end of its loop, the upper tong half 82 and the lower tong half 81 open as wide as they can, driven by suitable signals received from a control device, whereafter the packet 200, strapped or not, is deposited onto a subsequent line (e.g. a palletising device). The pair of packet tongs 80 goes back to its initial position as represented in FIG. 8A.

The entire machine 10 is preferably fully encapsulated by removable plastic walls monitored by safety switches, which enhances the safety of the system.

The machine is designed to process a wide range of products in an efficient way and not overload the operator with too many complex adjustments.

While the invention has been shown and described with reference to preferred embodiments, it will be understood by those skilled in the art that various changes or modifications in form and detail may be made without departing from the scope and spirit of this invention.

What is claimed is:

1. Machine for building a stack of stiff flat articles, comprising:

an input device for feed of a horizontal flow of flat articles in an overlapping shingled relationship and travelling in a first direction;

a pusher mechanism for engaging with a side of one of the flat articles and for driving a plurality of flat articles into a vertical stack at a first location; wherein:

the pusher mechanism comprises:

a transport means for movement in the first direction;

a bottom-pusher mechanism mounted on the transport means, and a top pusher mechanism mounted on the transport means, the machine further comprising:

a control device for controlling movements of the bottom or top pusher mechanisms, the control device controlling the operation of the top or bottom pusher mechanisms such that:

if the horizontal flow of articles is top-stacked, the bottom pusher mechanism engages a side of one of the flat articles and drives a plurality of the flat articles into the vertical stack, and if the horizontal flow of articles is under-stacked, the top-pusher mechanism at least pushes off a plurality of flat articles to form the vertical stack.

2. Machine according to claim 1, wherein, when the flat articles are under-stacked, the bottom pusher mechanism has means to move up and take over the stack formation from the top pusher mechanism.

3. Machine according to claim 1, wherein, when the flat articles are under-stacked the top pusher mechanism has means to engage a side of one of the flat articles and to drive the plurality of the flat articles into the vertical stack.

4. Machine according to claim 1, further comprising means to actuate the pusher mechanism so as to make a movement towards the first location which is accelerated with regard to the movement of the horizontal flow of flat articles.

5. Machine according to claim 1, wherein the movement of the pusher mechanism is controlled in place and height in accordance with the flat articles to be stacked by the control device.

6. Machine according to claim 1, further comprising a fixedly mounted guiding element with a runner for running up the moving shingled stream of flat articles, and a rotation encoder connected to the runner.

7. Machine according to claim 1, wherein the transport means is a carriage.

8. Machine according to claim 1, wherein the control device has means to control a movement of the pusher mechanism in time and place.

9. Machine according to claim 8, wherein the control device has means for controlling a time of starting the movement of the pusher mechanism, a rate of acceleration thereof and when the acceleration is to stop.

10. Machine according to claim 8, wherein control device has means to control the movement of the pusher mechanism in place and height in accordance with the flat articles to be stacked.

11. Machine according to claim 8, wherein the control device has means for actuating the pusher mechanism so as to make a movement towards the first location which is accelerated with regard to the movement of the horizontal flow of flat articles.

12. Machine according to claim 1 further comprising a transferring device for lifting the stack and transferring it to a second location.

13. Machine according to claim 12 wherein the transferring device has a gripper head having gripper arms, the gripper arms being adapted to embrace the stack.

14. Machine according to claim 12, wherein the transferring device has means to optionally rotate the stack through a predetermined angle between lifting the stack the first location and transferring it to the second location.

15. Machine according to claim 14, wherein the transferring device has means to rotate the stack about a vertical axis.

16. Machine according to claim 14, wherein the transferring device has a gripper head having gripper arms, the gripper arms being adapted to embrace the stack.

17. Machine for building a stack of stiff flat articles, comprising:

an input device for feed of a horizontal flow of flat articles in an overlapping shingled relationship and travelling in a first direction, the horizontal flow of articles being under-stacked;

a pusher mechanism for engaging with a side of one of the flat articles and for driving a plurality of flat articles into a vertical stack at a first location; wherein:

the pusher mechanism comprises:

a transport means for movement in the first direction;

a top pusher mechanism mounted on the transport means, the machine further comprising:

a control device for controlling movements of the pusher mechanisms, the control device controlling the operation of the top pusher mechanism such that:

the top-pusher mechanism at least pushes off a plurality of flat articles to form the vertical stack.

18. Machine according to claim 17, wherein the transport means is a carriage.

19. The machine according to claim 17, wherein the top pusher mechanism has means to engage a side of one of the flat articles and to drive the plurality of the flat articles into the vertical stack.

20. The machine according to claim 19, wherein the control device has means to control a movement of the pusher mechanism in time and place.

21. Machine for building a stack of stiff flat articles, comprising:

an input device for feed of a horizontal flow of flat articles in an overlapping shingled relationship and travelling in a first direction, the horizontal flow of articles being top-stacked;

a pusher mechanism for engaging with a side of one of the flat articles and for driving a plurality of flat articles into a vertical stack at a first location; wherein:

the pusher mechanism comprises:

a transport means for movement in the first direction;

a bottom-pusher mechanism mounted on the transport means and including at least one pusher, the machine further comprising:

a control device for controlling movements of the bottom-pusher mechanism, the control device controlling the operation of the bottom pusher mechanism such that: the bottom pusher mechanism engages a side of one of the flat articles and drives a plurality of the flat articles into the vertical stack, wherein the bottom-pusher mechanism comprises means to move the at least one pusher relative to the transport means in a second direction separately from the movement of the transport means in the first direction, the second direction being perpendicular to the first direction.

22. Machine according to claim 21, wherein the control device has means to control a movement of the pusher mechanism in time and place.

23. Machine according to claim 21, wherein the at least one pusher comprises a head with means for moving with respect to the at least one pusher.

24. Machine according to claim 21, wherein the transport means is a carriage.

* * * * *